United States Patent [19]

Dever et al.

[11] 4,386,645

[45] Jun. 7, 1983

[54] SIDE FOLDING CLOSURE

[75] Inventors: James E. Dever, Tresckow; John A. Stascavage, Exeter; William W. Rawls, Mountaintop, all of Pa.

[73] Assignee: Cornell Iron Works, Inc., Mountaintop, Pa.

[21] Appl. No.: 233,176

[22] Filed: Feb. 10, 1981

[51] Int. Cl.[3] ..... E05D 11/06; E05D 5/08

[52] U.S. Cl. ..... 160/183; 160/235; 16/355

[58] Field of Search ..... 160/84 R, 199, 235, 160/199, 235, 84, 183; 16/255, 256, 215, 376, 355, 274

[56] References Cited

U.S. PATENT DOCUMENTS

| | | | |
|---|---|---|---|
| Re. 29,308 | 7/1977 | Dagenais | 160/229 R |
| 2,586,561 | 2/1952 | Poggi | 160/33 |
| 3,118,702 | 1/1964 | Kale et al. | 160/235 X |
| 3,359,594 | 12/1967 | Pastoor | 160/199 |
| 3,405,756 | 10/1968 | Harris | 160/229 R |
| 3,648,328 | 3/1972 | McCabe | 16/355 |
| 4,228,841 | 10/1980 | Dixon | 160/235 |

FOREIGN PATENT DOCUMENTS

| | | | |
|---|---|---|---|
| 524228 | 8/1940 | United Kingdom | 16/355 |

*Primary Examiner*—Peter M. Caun
*Assistant Examiner*—Cherney S. Lieberman
*Attorney, Agent, or Firm*—Emory L. Groff, Jr.

[57] ABSTRACT

A closure includes a plurality of vertical panels suspended from an overhead support and successively joined to one another by interlocking, alternate outer and inner pivot elements attached to the panel lateral edges. When the closure is collapsed the panels are folded about the pivot elements into a stacked, parallel diposition. Improved articulation between the panels is achieved by means of unique outer and inner pivot element components including respectively, a curved groove and a curved arm, both describing an arc of approximately 270°. Female elements on the base of each pivot element cooperate with mating male elements joined to each panel lateral edge to allow ready assembly therebetween, with the panels themselves comprising either metal and/or a plastic composition.

7 Claims, 7 Drawing Figures

SIDE FOLDING CLOSURE

This invention relates generally to collapsible closures and more particularly to an improved closure including a plurality of articulated slats or panels adpated to be shifted to a collapsed position with all of the panels disposed in an accordion-fold manner.

Closures of the general type reflected by the present invention are becoming increasingly popular especially in view of the current surge in construction of enclosed shopping malls wherein the relatively wide opening leading into each individual shop requires a readily manipulated closure capable of providing security against unwarranted entry. Articulated, rolling or folding closures are especially adaptable for such installations since these closures when in a collapsed or storage position are more easily concealed within a relatively small pocket in either the side wall or ceiling.

In the case of folding closures, the smallest storage area for the folded or collapsed panels is obtainable by employing a construction which insures that the folded panels assume a closely stacked, parallel disposition with the center of the folded panels all located along a common straight line. The attainment of this feature relies for the most part upon the construction and configuration of the hinge means providing articulation between the individual adjacent panels.

An example of a prior effort at providing an accordion-fold, side acting closure will be found in the U.S. Pat. No. 3,359,594 to Pastoor, issued on Dec. 26, 1967 and which presents a hinge construction in a non-metallic folding closure comprising mating hinge elements including interlocking arcuate segments providing a transversely captive interlock between adjacent panels throughout the pivotal displacement of the panels between the expanded or extended position and the collapsed accordion-fold position.

The improvement offered by the present invention is particularly adapted in the formation of large size closures such as those utilized to enclose storefront openings and which are constructed primarily of shaped metal components such as extruded aluminum. The weight of the present closure is supported by means of a plurality of hanger assemblies engaging an edge of certain of the panels while axial alignment between the adjacent plurality of panels is maintained by retainer assemblies axially aligned with and disposed at opposite ends of the pivot axes defined by the pairs of mating pivot elements joining adjacent panels. The construction of the interlocking pivot elements readily lends itself to formation such as by extrusion and provides an outer pivot element having a curved arm providing a curved groove therein for the reception of a curved arm carried by a cooperating inner pivot element. As the closure is shifted from an extended mode with the panels extended, the individual interlocked panels will be understood to be pivotally displaced with respect to one another through an arc of less than 180° and the interlocking engagement therebetween is insured throughout this displacement by the formation of the above mentioned cooperating curved grooves and curved arms to provide mating components respectively describing arcs of approximately 270°.

The closure apparatus of the present invention may comprise panel sections of metal, plastic or a combination thereof without any modification of the construction of the outer and inner pivot elements interconnecting the panels. In this manner panel sections constructed of translucent or transparent non-metallic material may be employed. The advantage of clear panels will be obvious when considering that a store owner may wish to allow visual access to the interior of his store during those times when the closure is in the extended, secured position.

Accordingly, one of the objects of the present invention is to provide an improved side folding closure including a plurality of panels adapted to be collapsed into a stacked, parallel relationship and having lateral edges joined to one another by unique pivot elements.

A further object of the present invention is to provide an improved side folding closure including a plurality of articulated panels supported by hanger assemblies along an edge thereof and including intermediate panel sections of a disparate material.

Still another object of the present invention is to provide an improved hinge means for connecting adjacent edges of a plurality of panels and including mating pivot elements provided with interlocking arcuate components each defining an arc of approximately 270°.

A further object of the present invention is to provide an improved side folding closure having panels interlocked by mating pivot elements which elements are maintained in axial coincidence by means of retainer assemblies attached to the opposed ends of the assembled elements along the pivot axis thereof.

Another object of the present invention is to provide an improved side folding closure including a plurality of articulated panels having lateral edges formed with arcuate segments serving as mounting means for arcuate attachment arms of separate pivot elements intended to be secured to the panels.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figures 1, 2, 2A:
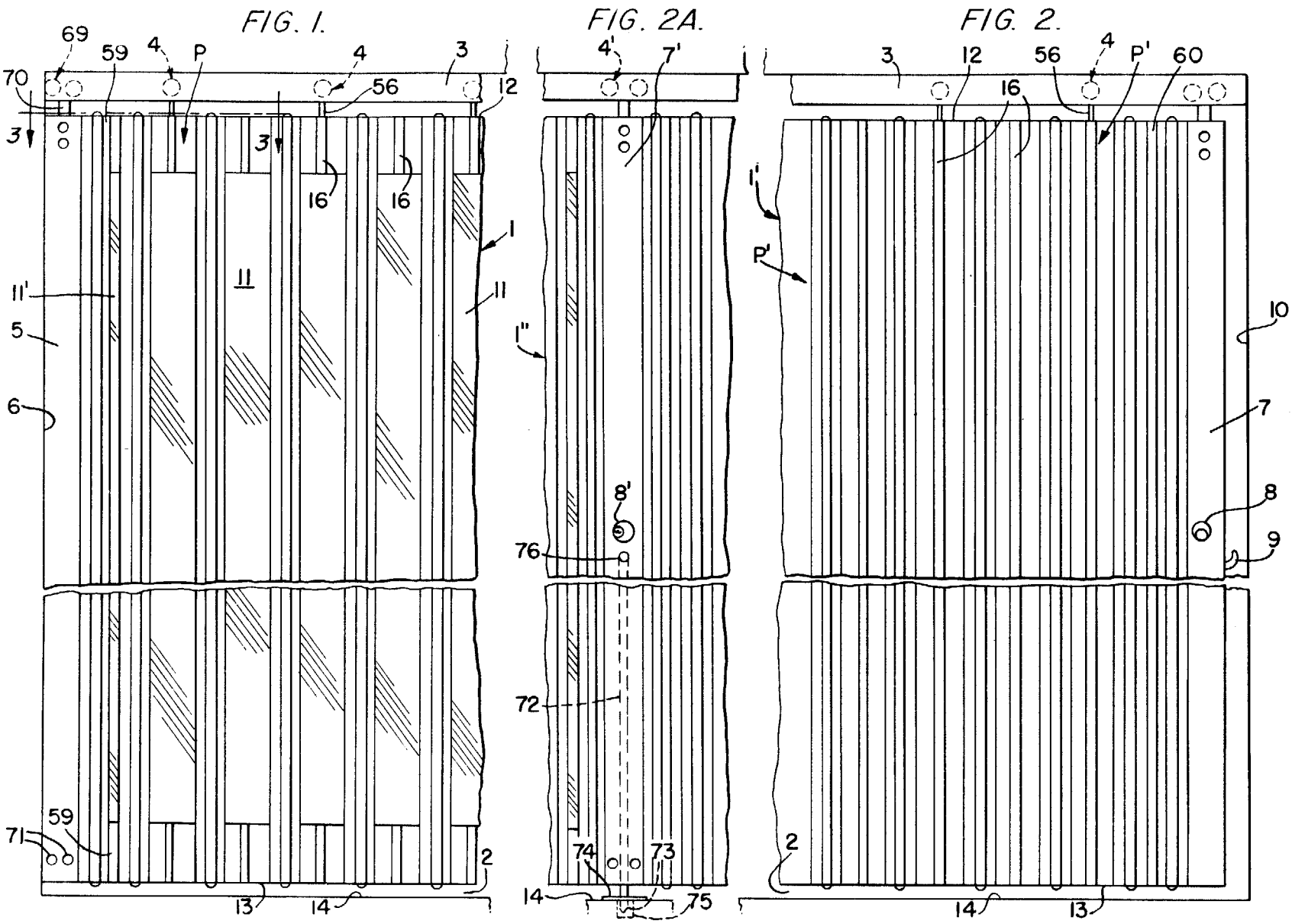
FIG. 1 is a partial front elevation of a side folding closure according to the present invention and including panel components of disparate material.
FIG. 2 is a partial front elevation illustrating a modification of the panels of the closure of FIG. 1.
FIG. 2A is a partial front elevation depicting a further closure modification including an intermediately located closure locking arrangement.

Referring now to the drawings, particularly FIGS. 1 and 2, the present invention will be seen to relate to a closure generally designated 1 or 1' and adapted to seal off or block physical access to a closure opening 2. The closures are shown suspended from an overhead support or track 3 by means of a plurality of curtain roller assemblies 4 to provide a side acting closure whereupon the plurality of slats or panels of the closure are collapsed or folded in an accordion manner when laterally displaced from the extended position shown in these figures. It will be appreciated that the concept of the instant invention may also be applied in constructing the closures such that the panels thereof are vertically raised and lowered as in an overhead closure system.

FIG. 1 illustrates the left-hand portion of a closure 1 wherein an end member 5 is fixed or suitably anchored with respect to the side wall 6 of a closure opening. This end member 5 may also be moveable so the curtain or closure may be stacked into a pocket within the wall 6 and thus, fully removed from the opening. In this instance, the top and bottom of the member 5 would be restricted from travelling beyond the mouth of the pocket by means of appropriate stoppers (not shown) on the track 3 and floor.

FIG. 2 illustrates the right-hand portion of the closure 1' and its shiftable end member 7 which may contain a suitable lock 8 to regulate the latch 9 cooperating with an appropriate keeper (not shown) associated with the side wall 10. Alternatively, the shiftable end member 7 may cooperate with another shiftable end member attached to an adjacent but separate section of a closure curtain (not shown). For the purpose of understanding the invention, the hinge assembly providing the articulation between the components of the two closures 1 and 1' is identical and the primary distinction between these two closure embodiments is the inclusion of non-metallic medial panel sections 11—11' in the embodiment of FIG. 1.

The remaining embodiment shown in FIG. 2A of the drawings depicts an arrangement wherein a closure 1'' is provided with an alternative lock assembly 8' carried by an intermediate member 7' and wherein the panel sections on both sides of the member 7' may comprise either non-metallic or metal panel sections, or a combination thereof as shown in the drawing figure.

From the above description, it will be appreciated that the inventive concept which will be described in detail hereinafter may be utilized in combination with closures adapted to operate in various manners.

Figure 5:
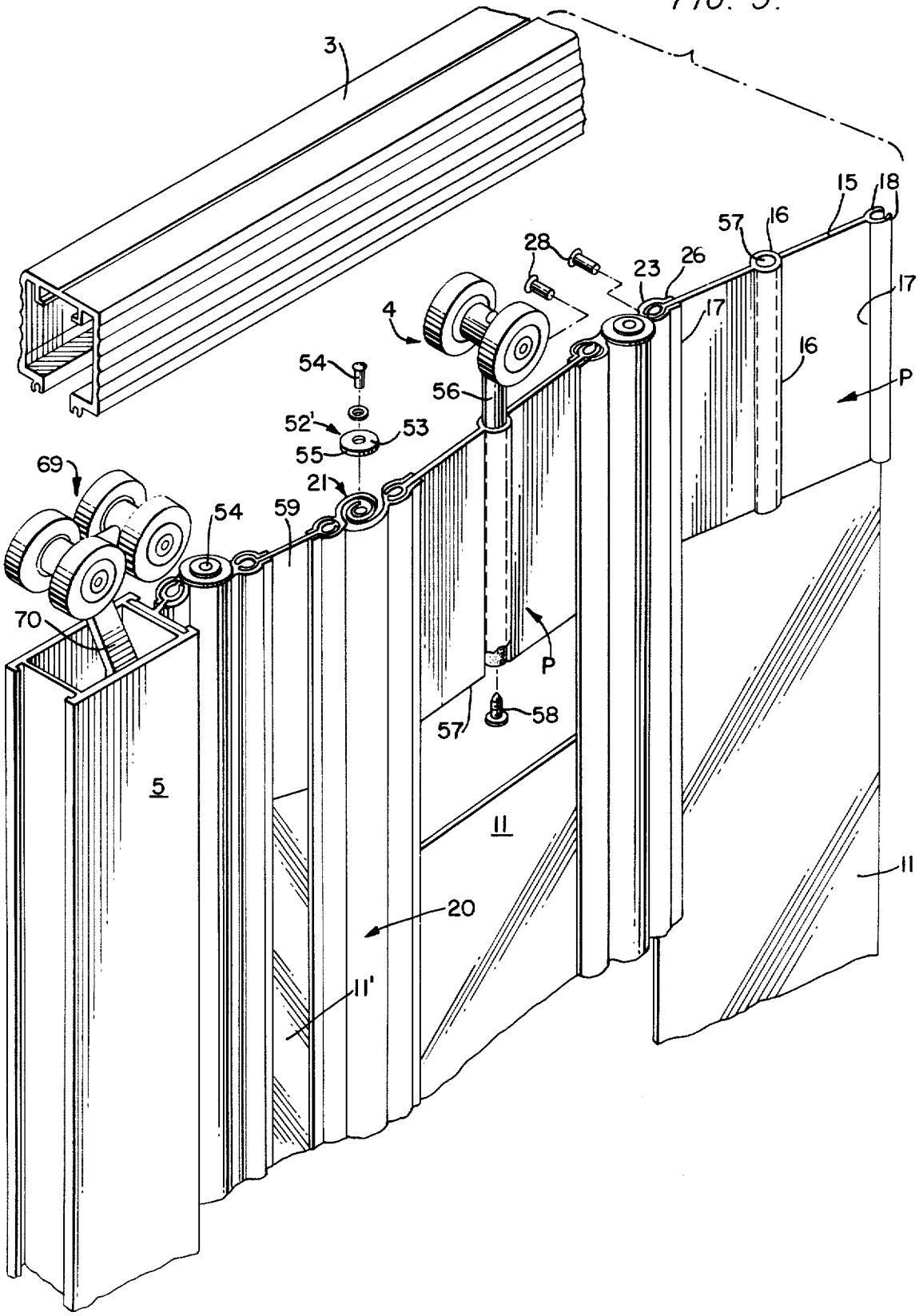
FIG. 5 is a fragmentary, top perspective view of the structure as shown in FIG. 3.

The various components of the present invention will most readily be appreciated when considering the illustration of FIG. 5 together with that of FIGS. 1-2 wherein it will be seen that the majority of the expanse of the closures is taken up by the vertical slats or panels. In either embodiment, a panel may be considered to extend vertically from the panel top end 12 disposed beneath the support track 3 to a panel bottom end 13 located adjacent the floor 14. These panels, at least adjacent the top end 12 and bottom end 13, each include a substantially planar panel body 15 having a centrally disposed medial enlargement 16. The opposite lateral edges 17 of each panel will be seen to be joined to a male element comprising a circular configuration such as the arcuate segments 18 the purpose of which will become clear hereinafter.

In the case of the embodiment of FIG. 1, the closure 1 will be seen to include a plurality of end panel sections P configured in the manner above described. The outer edges of these end panel sections P serve to form the panel top end 12 and bottom end 13 previously referred to while the majority of the vertical extent of the closure 1 is formed by intermediate panel sections 11 comprising planar, non-metallic members such as clear or transparent plastic material. As shown most clearly in FIG. 5 of the drawings, these latter panel sections 11 are preferably totally planar, that is, they are not provided with the medial enlargement 16 or arcuate segments 18 of the end panel sections P, the latter of which are preferably formed of extruded metal such as aluminum.

In the case of the enclosure 1' of FIG. 2, each panel P' comprises a unitary component preferably of extruded metal, extending between the opposed ends 12 and 13 and its cross-sectional configuration is identical to that of the aforedescribed end panel sections P. Whether or not the closure comprises a combination of the end panel sections P and intermediate panel sections 11 or solely a plurality of the full length panel sections P', the hinge means for providing articulation between the plurality of panel sections is identical and will now be described.

Figure 3:
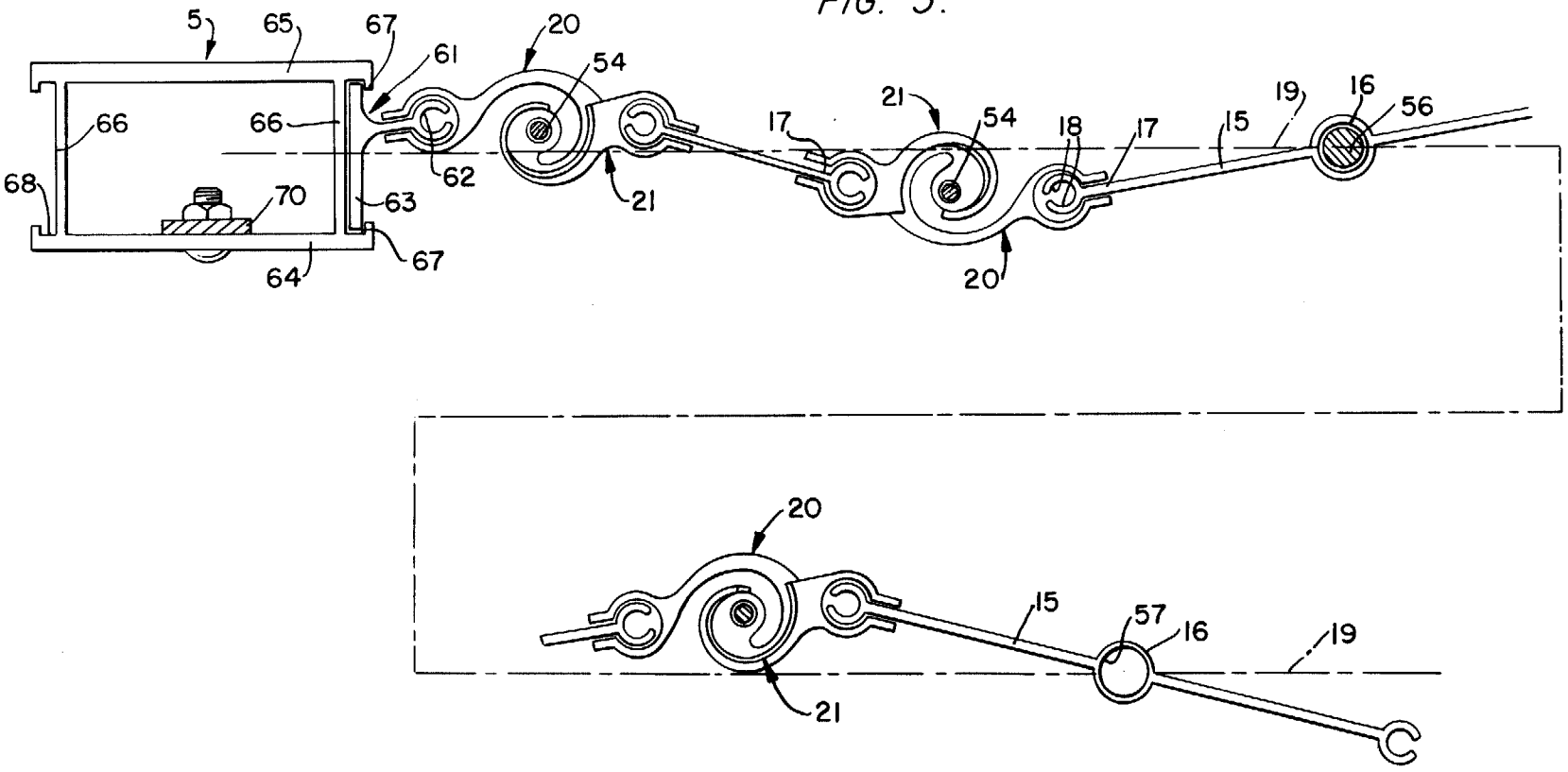
FIG. 3 is an enlarged horizontal section taken along the line 3—3 of FIG. 1.

The hinge assembly joining the adjacent lateral edges 17 of the plurality of panel sections is constructed such that when the panel sections are fully extended as shown in the positions of FIGS. 1-3, the hinge components will be diposed as shown in FIGS. 3 and 5 of the drawings wherein it will be observed that the panel sections are not fully extended along a single straight line but are slightly offset with respect to the closure center line 19 with alternate pairs of the cooperating hinge means disposed on opposite sides of the center line 19.

Figure 4:
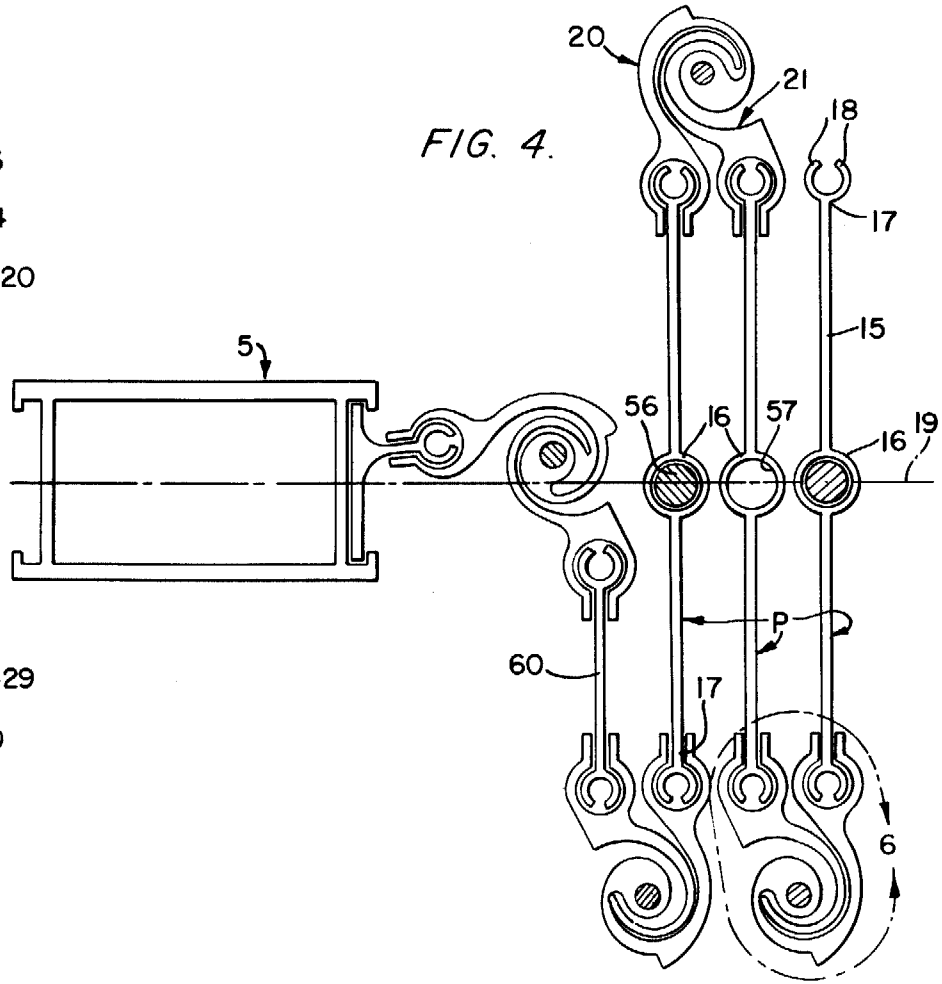
FIG. 4 illustrates the position of the components of FIG. 3 when in the collapsed position.

With the realization that the medial portion 16 of every other panel section at all times remains aligned with the center line 19, it will follow that this arrangement permits collapsing of the various panel sections from the extended position of FIG. 3 to the collapsed position of FIG. 4 merely by displacing the shiftable end member 7 of a closure towards its fixed or shiftable end member 5. Each articulated joint between adjacent lateral edges 17 of the panel sections is served by a hinge assembly H including a pair of hinge components comprising an outer pivot element 20 and an inner pivot element 21.

Figure 6:
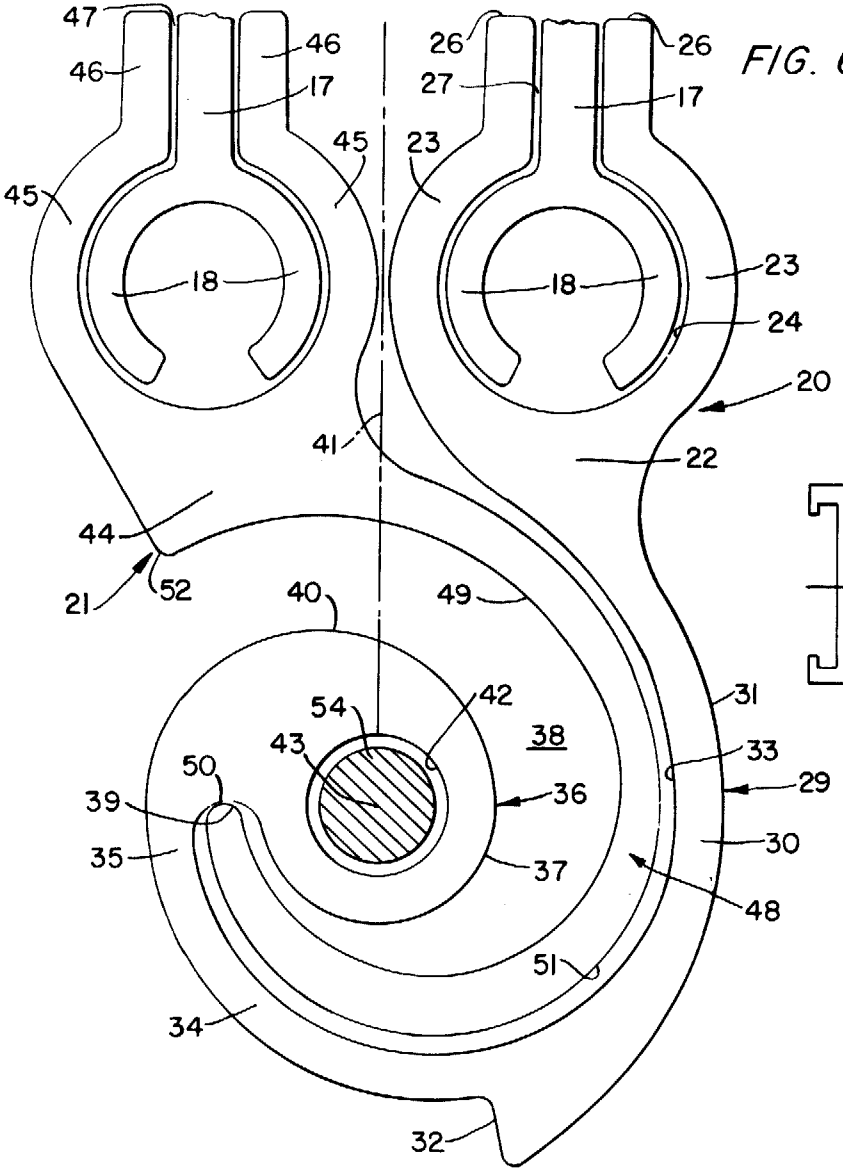
FIG. 6 is an enlarged view of the two pivot elements encircled in FIG. 4.

The construction of the two pivot elements is shown most clearly in the enlarged view of FIG. 6 of the drawings, wherein it will be seen that the outer pivot element 20 includes a base 22 having a pair of female elements comprising arcuate attachment arms 23 providing a cylindrical bore 24 adapted to closely surround and contain the arcuate segments 18—18 forming the male attachment arms of the panel sections. Distal portions of the two opposed attachment arms 23 comprise a pair of parallel flanges 26—26 spaced apart to provide a throat 27, the distance therebetween providing a close fit about opposite faces of the panel body lateral edges 17.

With the above construction in mind, it will be appreciated that assembly of the various panel sections with each of the plurality of outer pivot elements 20 is readily achieved by merely axially inserting the male element segments 18 of the panel sections within the cylindrical bore 24 of the pivot element base 22 whereafter this assembly is maintained by the application of one or more panel section fasteners 28 disposed through the pivot element flanges 26—26 and the panel body lateral edge 17 sandwiched therebetween, such as shown in FIG. 5 of the drawings.

The balance of the outer pivot element 20 includes a curved arm, generally designated 29, provided with a first segment 30 extending away from and opposed the pivot element base 22 and having an outer surface 31 terminating in a radially extending stop shoulder 32 and which offers the most distant point of the outer pivot element disposed away from its associated panel section. From the enlarged view of FIG. 6, it will be seen that the inner surface 33 of the curved arm 29 continues as a smooth curve beyond the distal portion of the first segment 30 to define a second curved segment 34 and which terminates at the end 35 of the second segment. Joined to this end 35 is a curved arm cylindrical enlargement 36 which extends inwardly from the end 35 of the second segment toward the inner surface 33 of the medial portion of the first segment 30 and which includes an outer surface 37 well spaced from the inner surface of the curved arm 29 to define therebetween a curved groove 38. With the above structure in mind, it will be understood that the bottom or closed end 39 of the groove defines the narrowest width of the groove and is disposed at a point which is approximately 270° from the beginning or opening of the groove 38 located between the top 40 of the cylindrical enlargement 36 and the base 22 of the pivot element 20. Additionally, it will be noted that the groove bottom or end 39 is disposed well beyond the center line 41 extending between two adjacent folded parallel panel sections.

The body of the curved arm cylindrical enlargement 36 is provided with an axial opening or bore 42 the center 43 of which is co-located along the above mentioned panel intermediate center line 41. For ease of fabrication, this bore 42 may extend throughout the entire axial extent of the outer pivot elements 20 although for purposes of final assembly, it is only necessary that this opening 42 extend inwardly a short distance from each end of the pivot element in order to receive a fastener element as will be described hereinafter.

As shown most clearly in FIGS. 3 and 4 of the drawings, every second panel body 15 is provided with one of the above described outer pivot elements 20 attached to each of its two lateral edges 17—17. These pivot elements 20 thus each cooperate with one of the inner pivot elements 21 similarly affixed to the two lateral edges 17—17 of the intermediate ones of the panel bodies 15. The detailed construction of each of these inner pivot elements 21 will be most clear from a review of FIG. 6, wherein it will be seen that each element 21 is provided with a base 44 from which extend a pair of opposed arcuate attachment arms 45—45 providing a female element identical to the corresponding structure attached to the base 22 of the outer pivot elements 20. Likewise, a pair of spaced apart parallel flanges 46—46 extend from the distal portion of the attachment arms 45 to provide an intermediate throat 47 for the reception of the lateral edge 17 of the associated panel body 15 in order to allow acceptance of the arcuate segments 18 forming the male attachment arms insertable within the cylindrical bore 24 of the base 44.

The remainder of the structure of the inner pivot element 21 extending outwardly from its base 44 substantially differs from the cooperating structure of the outer pivot element 20 and includes a single cuved arm generally designated 48 extending from that portion of the base 44 adjacent the panel intermediate center line 41 and which will be seen to include a smoothly curved inner surface 49 extending as a continuation of the outer-most surface of the base 44 to a point defining a distal portion 50 of the curved arm 48, such that a curved arm is formed describing an arc of approximately 270°. The thickness of the curved arm 49 as defined by the width between its inner surface 49 and outer surface 51 may be substantially constant throughout its length and will be seen to be significantly less than the width of the associated curved groove 38 as defined by the cooperating outer pivot element 20. The relative arcuate extent of the cooperating curved arm and curved groove will be seen to be such that when the closure is folded as in the view of FIG. 6, the distal portion 50 of the inner pivot element curved arm 49 coincides with the bottom 39 of the outer pivot element groove 38.

During displacement of the closure from the collapsed or folded position of FIGS. 4 and 6, the base 22 of each outer pivot element 20 and the base 44 of the cooperating inner pivot element 21 will be understood to open up or move apart from one another as the closure is displaced to the expanded, extended position of FIG. 3 of the drawings. During this displacement, as the various panel sections are moved from a stacked, parallel disposition to the extended position of FIG. 3 wherein the panel sections are slightly offset with respect to the center line 19, the cooperating outer and inner pivot elements 20 and 21 along with their attached panel sections, are pivoted about the axial lines establishing the centers 43 of the bores 42 of the outer pivot elements 20. This articulation is achieved as the surfaces of the inner pivot element curved arm 48 engage the juxtaposed surfaces of the outer pivot element curved groove 38 and continues until the radially extending outer pivot stop shoulder 32 strikes an inner pivot abutment surface 52 formed on the base 44 of the inner pivot element 21 and which intersects one end of the curved arm inner surface 49. During this displacement of the closure 1 or 1' between its two limits of movement, the cooperating pairs of inner pivot elements 21 and outer pivot elements 20 will be understood to be arculately displaced an amount which is less than 180° so as to insure achievement of the slightly offset disposition between adjacent panel sections as depicted in the extended position of FIG. 3. Thus, the location of the outer pivot stop shoulder 32 with respect to the inner pivot element abutment surface 52 is critical and as shown in the collapsed position of FIG. 6, these two surfaces are less than 180° apart.

With each panel section provided with a pair of similar pivot elements 20 or 21, and with each laterally adjacent panel section provided with an identical pair of the opposite type of pivot elements, the assembly of these plurality of panel sections and intermediate interlocking pivot elements is retained in the proper alignment merely by precluding axial shifting between the interlocked pivot elements. This is readily achieved by means of the retainer assemblies 52' such as shown in FIG. 5 of the drawings and which include a washer 53 overlying the end portions of each of the assembled pivot elements and secured by means of a suitable fastener 54 anchored within the bore 42 of the outer pivot elements 20. The diameter of the washer 53 is selected such that its periphery 55 at least overlies the end of the outer pivot element curved arm 29. In this manner, it will be appreciated that the interlocked pair of pivot elements 20 and 21 will be precluded from any axial displacement relative one another as the washer 53 is locked in place by the outer pivot element and the cooperating curved arm 48 of the inner pivot element is contained beneath the washer.

The plurality of assembled panel sections is suspended for rectilinear displacement, from the overhead track 3 by means of a plurality of curtain roller assemblies 4 which travel longitudinally within the track 3 and include the depending hanger rods 56. The medial enlargement 16 formed in the body of the end panel sections P and full panel sections P' serve not only as a reinforcing rib member for the panel sections but also act to receive the hanger rods 56 within the bores 57 thereof. In the case of the end panel section P, the hanger rods 56 extend to a point adjacent the inner edge 57 thereof at which point a suitable retaining fastener 58 secures the roller assembly 4 with respect to the end panel section P and since this end panel section P is appropriately secured with respect to the cooperating adjacent pivot elements 20–21, by means of the fasteners 28, it will be understood that the entire closure is offered adequate support.

Although each of the end panel sections P and full panel sections P' is provided with the medial enlargement 16 in order to standardize the fabrication of the closure components, it usually suffices to employ a curtain roller assembly 4 at only every other one of the medial enlargements 16 as shown in FIGS. 1 and 2 of the drawings.

The use of alternate roller assemblies allows unsupported panels to drift beyond the closure centerline 19 allowing each individual hinge assembly H to close or open independently (to an extent) of the other hinge assemblies. This alternate placement of the roller assemblies 4 also allows the use of curved tracks with relatively small radius curves to be used for suspending the closure.

The hanger rods 56 of the roller assemblies 4 employed in the closure 1' of FIG. 2, may extend the full length of the panel sections P' and be suitable anchored at the panel bottom end 13 by the same type of fastener 58 as employed in the embodiment shown in FIG. 5 or alternatively, a shortened hanger rod 56 may be used with any suitable expansion type anchor thereon (not shown).

To insure maintenance of the tracking of the panel section medial enlargements 16 along the closure center line 19 during operation of the closure, and to secure the complete parallel disposition of all of the panel sections in the most compact manner when in the collapsed folded position, partial panel sections are employed as the last panel element adjacent the end member 5 as shown in FIGS. 3–5. In the case of the embodiment of FIG. 1, this panel section will include top and bottom partial end panel sections 59—59 associated with an intermediate partial panel section 11' while in the case of the embodiment of FIG. 2, this panel section will include a partial full panel section 60 and would appear as shown in FIG. 4 if the closure of this view was of the type as depicted in FIG. 2.

In either above instance, the stationary portion of the closure is anchored with respect to the end member 5 while utilizing an outer pivot element 20 disposed with the center 43 of the bore 42 fixedly supported to one side of the closure center line 19 as shown in FIG. 3. This support is readily achieved by means of a curtain anchor 61 having a male attachment member 62 similar to the male attachment members 18 of the panel sections and which is affixed to a base 63. As shown in this Fig. of the drawings, the end member 5 includes a front plate 64 and an opposite rear plate 65 joined by the pair of opposed side plates 66. The front and rear plates extend beyond the side plates and will be seen to be inturned to provide the pair of opposed flanges 67—67 forming a channel 68 for slidably receiving the base 63 of the curtain anchor 61.

To provide initial support for the end member 5 and to facilitate subsequent servicing of the closures, and end member roller assembly 69 disposed within the track 3 is attached to the top of the end member 5 by means of the bracket 70. If the member 5 is stationary, additional appropriate means are included to securely affix this member 5 juxtaposed the closure opening side wall 6 such as the fasteners 71. On the other hand, as previously mentioned, the end member 5 may also be moveable so the closure may be stacked into a pocket away from the opening. In this case, the top and bottom of the member 5 would be restricted by track and floor stoppers to stop the member from travelling beyond the mouth of the pocket.

The alternate locking arrangement shown in the closure 1'' of FIG. 2A includes an intermediate lock member 7' which is substituted for one of the panel sections P' or a combination of panel sections 11 and P and is located at any desired point between the two end members 5 and 7 of the closure. A suitable lock 8' cooperates with a drop bolt 72 passing through the member 7' and terminating in a bolt end 73 adapted to engage a keeper 74 mounted adjacent a recess 75 in the floor 14. An appropriate bolt actuator 76 permits manipulation of the drop bolt in conjunction with the lock 8'. The member 7' is preferably supported from the track 3 by a tandem roller assembly 4'.

From the foregoing, it will be appreciated that an improved closure assembly is provided including panel sections which may alternatively be of similar or dissimilar material and which are readily assembled with unique interlocking outer and inner pivot elements to insure a smoothly operating, linearly displaceable closure collapsible to a stacked position with the plurality of panel sections disposed in a parallel manner occupying a minimum amount of space.

We claim:

1. A closure including, a plurality of panel sections having opposite ends and lateral edges, hinge assemblies joining opposed lateral edges of adjacent said panel sections, said hinge assemblies including cooperating outer and inner pivot elements comprising separate elements each respectively joined to said opposed lateral edges of adjacent panel sections, said outer and inner pivot elements each having a base joined to an adjacent said lateral edge, a curved arm extending from said outer pivot base, said arm having an inner surface and outer surface and provided with an end disposed to describe a curved arm arc substantially greater than 180°, a cylindrical enlargement extending radially inwardly from said arm end and having a curved outer surface spaced from said arm inner surface to define a curved groove therebetween describing an arc substantially greater than 180°, a single curved arm extending from said inner pivot base and freely insertable within said outer pivot groove, said inner pivot curved arm describing an arc substantially greater than 180°, said inner pivot element curved arm having inner and outer surfaces loosely disposed within said outer pivot element groove during relative angular displacement of said inner and outer pivot elements, cooperating abutment means on said outer and inner pivot elements disposed respectively on the intermediate portion of said outer pivot curved arm outer surface and on said inner pivot base, said outer pivot element abutment means comprising a stop shoulder projecting outwardly from an intermediate point on said outer pivot element curved arm, female attachment means on said outer and inner pivot element bases, male attachment means extending from said panel section lateral edges and axially insertable within said female attachment means and fastener means fixing each said female attachment means relative its attached panel section inwardly of said panel section ends whereby, with said inner pivot curved arms inserted within said outer pivot grooves of each of said hinge assemblies, said closure is shiftable from an extended position with said panel sections extended and said cooperating abutment means engaging one another, to a stacked position with said panel sections collapsed into a stacked parallel arrangement.

2. A closure according to claim 1 wherein, said lateral edges of any one said panel section are both joined to a similar pair of said outer or inner pivot elements and both said lateral edges of said panel sections adjacent said one panel section are joined to a pair of similar pivot elements unlike said pair of pivot elements joined to said one said panel section whereby, alternate panel sections are each provided with pairs of outer or inner pivot elements respectively.

3. A closure according to claim 1 including, a support track adjacent one said panel section ends, a plurality of roller assemblies carried by said track and displaceable therein along a closure center line defined by said track, said panel sections including a body having a hollow enlargement disposed medially of said lateral edges, said roller assemblies provided with a hanger rod extending into said enlargements, means axially securing said rods relative said enlargements whereby, during said shifting of said closure from said extended to said stacked position all said panel body enlargements are displaced along said closure center line and when collapsed to said stacked position said enlargements are juxtaposed one another.

4. A closure according to claim 1 wherein, each said hinge assembly includes opposite ends substantially planar with said panel section ends, and a retainer assembly affixed in overlying relationship to said hinge assembly ends to preclude axial displacement between said hinge assembly outer and inner pivot elements.

5. A closure according to claim 1 wherein, said arm and groove of said outer pivot element and said arm of said inner pivot element describe an arc of substantially 270°.

6. A closure according to claim 1 wherein, said panel sections comprise metallic components extending between said opposite ends.

7. A closure according to claim 1 wherein, at least certain said panel sections each include axially aligned panels of disparate material.

* * * * *